United States Patent [19]

Levy et al.

[11] Patent Number: 4,764,675

[45] Date of Patent: Aug. 16, 1988

[54] SELF-TENSIONING CORONODE STRUCTURE

[75] Inventors: Gail J. Levy, Fairport; Gerald M. Fletcher, Pittsford, both of N.Y.

[73] Assignee: Xerox Corporation, Stamford, Conn.

[21] Appl. No.: 111,383

[22] Filed: Oct. 22, 1987

[51] Int. Cl.[4] ..... H01T 19/04

[52] U.S. Cl. ..... 250/324; 250/326

[58] Field of Search ..... 250/324, 325, 326; 361/230; 355/3 CH

[56] References Cited

U.S. PATENT DOCUMENTS

| | | | |
|---|---|---|---|
| 3,499,143 | 3/1970 | Martin | 250/324 |
| 3,566,223 | 2/1971 | Salger | 361/230 |
| 4,110,811 | 8/1978 | Hubble, III et al. | 361/225 |
| 4,258,258 | 3/1981 | Laing et al. | 250/324 |
| 4,320,957 | 3/1982 | Brown et al. | 250/326 X |

FOREIGN PATENT DOCUMENTS

| | | | |
|---|---|---|---|
| 0196553 | 11/1983 | Japan | 355/3 CH |

*Primary Examiner*—Eugene R. LaRoche
*Assistant Examiner*—Seung Ham
*Attorney, Agent, or Firm*—Mark Costello

[57] ABSTRACT

A charging device provided with an integral arrangement for tensioning coronodes. The charging device is useful for mounting a double length prefabricated wire coronode having a predetermined length, and provided with coronode connectors at each end. The device includes first and second insulating end blocks supporting the coronode in charging position with respect to a surface to be charged, at least one of the end blocks adaptable for electrically connecting the coronode to a power supply, a coronode support member supported on the first end block for supporting a looped end of the coronode at the first end block and a coronode tensioning arrangement on the second end block, for applying tension to the coronode, including a pivot member for supporting the free ends of the coronode and mounted for pivoting movement between first and second positions. The first position of the pivoting movement allows connection of the coronode connector to the coronode connector anchor while the coronode is untensioned, and the second position of the pivoting movement applies a selected tension to the coronode.

9 Claims, 2 Drawing Sheets

SELF-TENSIONING CORONODE STRUCTURE

The present invention relates generally to charging devices for use in electrostatographic devices and more particularly to corona charging devices for use in such machines, which provide repairable and replaceable structures.

BACKGROUND OF THE INVENTION

In electrostatographic applications such as xerography, a charge retentive surface is electrostatically charged, and exposed to a light pattern of an original image to be reproduced to selectively discharge the surface in accordance therewith. The resulting pattern of charged and discharged areas on that surface forms an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals, where a charged surface may be discharged in a variety of ways.

It is common practice in electrophotography to use corona charging devices to provide electrostatic fields driving various machine operations. Thus, corona charging devices are used to deposit charge on the charge retentive surface prior to exposure to light, to implement toner transfer from the charge retentive surface to the substrate, to neutralize charge on the substrate for removal from the charge retentive surface, and to clean the charge retentive surface after toner has been transferred to the substrate. These corona charging devices normally incorporate at least one coronode held at a high voltage to generate ions or charging current to charge a surface closely adjacent to the device to a uniform voltage potential, and may contain screens and other auxiliary coronodes to regulate the charging current or control the uniformity of charge deposited. A common configuration for corotron corona charging devices is to provide a thin wire coronode tightly suspended between two insulating end blocks which support the coronode in charging position with respect to the photoreceptor and also serve to support connections to the high voltage source required to drive the coronode to corona producing conditions. The coronode is partially enclosed by a conductive shield held at ground potential which serves to increase corona current produced. It is often desirable to have two coronodes within the same structure, which effectively increases the width of the charging zone for the improvement of charging uniformity, and which may be provided by a single wire of double the required length, having free ends of the wire anchored at one end block and a looped end anchored at the opposite end block. It is common in wire coronode structures to provide a spring connector to anchor an end of the coronode to an insulating end block. Scorotron corona charging devices have a similar structure, but are characterized by a conductive screen or grid interposed between the coronode and the photoreceptor surface, and held at a voltage corresponding to the desired charge on the photoreceptor surface. The screen tends to share the corona current with the photoreceptor surface. As the voltage on the photoreceptor surface increases towards the voltage level of the screen, corona current flow to the screen is increased, until all the corona current flows to the screen and no further charging of the photoreceptor takes place. It is to be noted that it is desirable that the screen be supported in a rigid, flat manner, so that it is uniformly spaced from the photoreceptor.

In use, wire coronode corotrons and scorotrons are noted for the ability to produce a reasonably uniform charge on a charge retentive surface. However, over time, the environment to which the coronode is exposed begins to cause irregularities and degradation in charging uniformity. These irregularities may be traced to surface irregularities on the coronode surface which over time becomes pitted, or coated with toner or fuser release agent or other process by-products which must be removed. While cleaning the coronode serves to improve the charging characteristics, coronodes eventually require replacement due to further degradation in performance, or breakage which often occurs while cleaning.

Heretofore, stringing the coronode into position between the insulating end blocks has required a degree of expertise outside the ability of most users. The primary difficulty in the procedure is to obtain the appropriate tension on the wire. If the tension is too low, undesirable sagging of the wire occurs, with resultant charging non-uniformity. If the tension is too high, breakage of the coronode may result. It would be highly desirable to have a corona charging device with a coronode allowing stringing in a simple manner so that a moderately trained user, rather than a service representative, could change or replace the coronode. Such an arrangement would allow significant savings in service time, machine dcown time and allow operator participation in maintaining copy quality. Of course, an added advantage would be the ease of coronode replacement by the service representative, decreasing his time in performing this job on a regular service call.

In the past a wide variety of arrangements have been used to support coronodes in position with respect to the charging device, and maintain a satisfactory degree of tension on the coronode. Thus, for example, U.S. Pat. No. 3,499,143 to Martin discloses a corona charging device including a spool of wire supported within the device so that it is readily available for use. The spool is supported so that it is selectably rotatable to remove wire from the spool for stringing the device, or to hold the end of the coronode in a fixed position. At an opposite end of the corona charging device, a pulley is provided around which the wire is supported and returned to the spool end of the device, where the free end of the wire is anchorable with a screw. A spring biased lever rotates the spool unitl the wire is in a taut condition, prior to fixing the free end at the screw anchor. This arrangement requires significant judgment in the installation of the wire, observing the wire and spring tension. U.S. Pat. No. 4,110,811 to Hubble, III et al discloses a useful arrangement which removes most judgment from the installation, providing a compression spring fixed to a coronode wire at a first end and a fixed ball terminator at a second end, and relies on the compression spring to maintain tension. Such a termination arrangement is relatively expensive, however, and the dielectric materials commonly used for the terminations cannot withstand long exposures to high voltages normally found in corona devices. U.S. Pat. No. 4,258,258 to Laing et al shows a generally similar arrangement in which one end of a coronode is provided with a bead termination and supported within a channel, while the other end extends through an insert to a tensioning means, where cooperating collars serve to retain the coronode end in the insert against any force pulling it out of the insert. Inserts supporting the coronode in position can be made chemically non-reactive. U.S. Pat. No. 3,566,223 to Salger teaches an adjustable wedge-type clamping mechanism. One end of the corona charging device includes a double clamping arrangement to fix both ends of the wire in position, while the opposite end provides a spring loaded abutment, wherein tension on the wire is achieved by removal of the spring.

SUMMARY OF THE INVENTION

In accordance with the invention there is provided a corotron or scorotron corona charging device having a wire coronode member which allows easy insertion into operational charging position in the device.

In accordance with one aspect of the invention, a charging device such as a corotron or scorotron generally includes a pair of insulating end blocks supporting a coronode in operational relationship to a surface to be charged. A first end block is provided with a coronode support for receiving the looped portion of a double length coronode. The second end block provides a cover hingedly mounted adjacent an enclosure formed in the end block. Coronode receiving anchors are provided on the pivotably movable cover which receive connectors attached to the ends of the coronode. Pivoting movement of the cover on the end block supports the anchors in a first, open position allowing connection of the coronode connectors to the anchors while the coronode is untensioned, and tensions the coronode when moved to a second, closed position which encloses the connectors and anchors within the end block enclosure.

In accordance with another aspect of the invention, the coronode support on the first end block provides a spring member normally extending to a position above the end block for receiving the untensioned coronode, and biasable by a cover to an enclosure in the first end block on completion of mounting the coronode.

The described arrangement finds particular utility in use with prefabricated coronodes, supplied to the installer at predetermined lengths, and having wire connectors already in place on the coronode ends.

These and other aspects of the invention will become apparent from the following description used to illustrate a preferred embodiment of the invention read in conjunction with the accompanying drawings in which.

Figure 1:
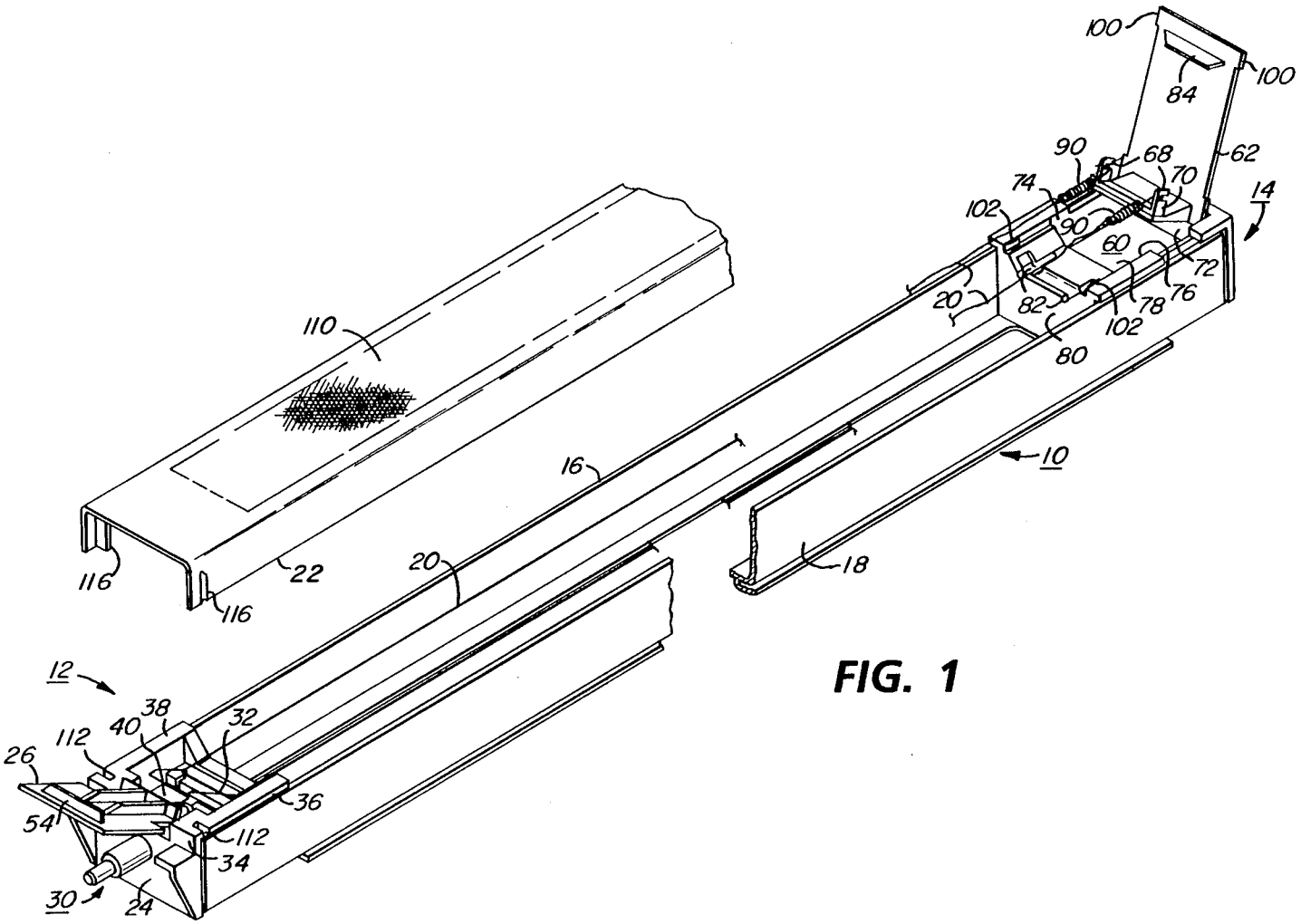
FIG. 1 is a partially exploded perspective view of a corona charging device in a scorotron configuration.

Referring now to the drawings where the showings are for the purpose of describing a preferred embodiment of the invention and not for limiting same, FIG. 1 shows a corona charging device 10, in this case configured as a scorotron. Corona charging device 10 is generally provided with first and second end blocks 12 and 14, a shield comprising shield members 16 and 18 which in the preferred embodiment provide a rigid support for the device, a double length coronode 20 supported between first and second end blocks 12 and 14, and screen member 22. The description hereinafter is applicable to a corotron, without modification other than removal of the screen 22.

Figure 2:
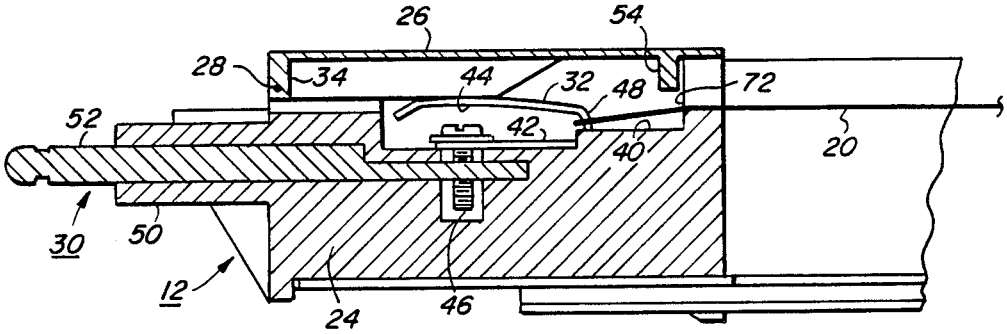
FIG. 2 is a cutaway view of a first end of the inventive corona charging device.

With reference now to FIGS. 1 and 2, and in accordance with the invention, first end block 12 is molded from an insulative resin material and generally includes a main body 24 and a cover 26 hingedly mounted with a hinge 28 to main body 24. Main body 24 supports an electrical connector 30 suitable for connection to a high voltage power source (not shown) for driving coronode 20 to a corona producing condition, and a coronode wire guide 32 around which the double length coronode 20 will be looped and supported at the first end block. Main body 24 forms a partial enclosure around coronode wire guide 32, having walls 34, 36 and 38 extending upwardly from a base portion 40 on which coronode wire guide 32 is supported. An opening in the enclosure is provided along the side of end block 12 opposing second end block 14, through which coronode 20 extends to coronode wire guide 32. In the described embodiment, coronode wire guide 32 is generally a closed loop having a generally rectangular shape, with a fastener receiving portion 42 extending from rectangular portion 44 to receive a fastener 46 such as a screw therethrough and extending into base 40 to secure coronode wire guide 32 into position. The rectangular portion of coronode wire guide 32 extends from fastener receiving portion 42 along base 40 towards the opposite end block 14, and is then bent back upon itself to form a V-shaped receiving portion 48 which will support the looped end of coronode 20 in position at the coronode support member 32 on end block 12. Coronode wire guide 32 is formed from a conductive metal material having a spring constant associated with it. The portion of the coronode wire guide 32 which is bent back on itself is formed at an angle which normally allows a portion of the guide to extend somewhat above walls 34, 36 and 38, to allow the coronode to be easily looped around the coronode wire guide 32, and is compressible into the enclosure with the closure of cover 26 after receiving coronode 20 thereabout. Electrical connector 30 generally includes a contact support 50 integrally formed with end block 12 supporting contact 52 which extends through contact support 50 and the main body of end block 12 into electrical connection with fastener 46 to provide an electrical connection with coronode wire guide 32 and accordingly, coronode 20. Cover 26 and walls 36 and 38 may be provided with complementary locking tabs and receiving openings (not shown) molded thereon to lock cover 26 into a closed position thereby enclosing coronode wire guide 32. Cover 26 is provided with an extension wall 54 which extends downwardly from the cover to substantially complete the patial enclosure of the main body 24 around the coronode wire guide 32 as the cover is closed.

Figure 3:
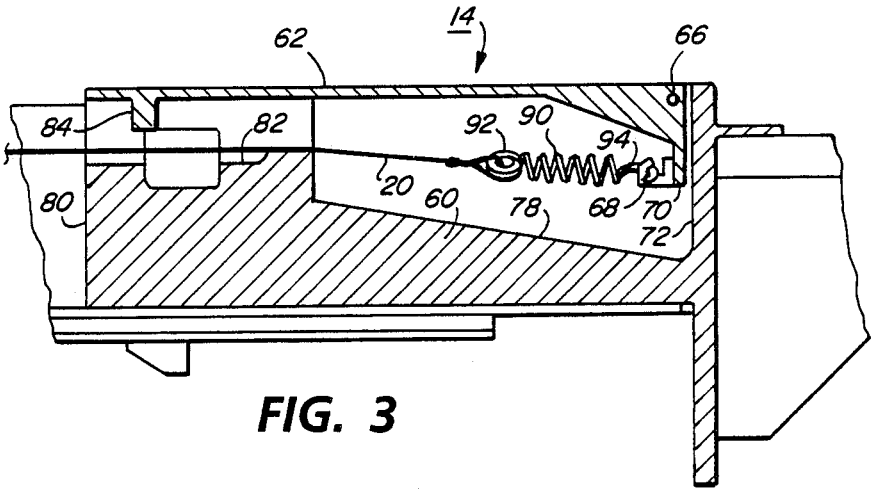
FIG. 3 is a cutaway view of second end of the inventive corona charging device.

With reference now to FIGS. 1 and 3, and in accordance with another aspect of the invention, second end block 14 is provided with a coronode tensioning arrangement for easily anchoring the coronode 20 and exerting the proper tension thereon. Second end block 14 may be molded from a non-conductive resin material and generally includes a main body 60 and a cover 62 hingedly mounted with hinge 66 to main body 60 for pivotal movement between open and closed positions, illustrated respectively in FIGS. 1 and 3. Cover 62 supports a pair of coronode connector anchors 68 in the form of generally C-shaped hooks. Anchors 68 are supported on an extension member 70 which extends perpendicularly from cover 62 at a position close to hinge 66. Anchors may be integrally molded with the cover and extension member, or formed from a metal member and fixed with fasteners to extension member 70. Main body 60 is provided with walls 72, 74 and 76 extending upwardly from a base 78 to form a partial enclosure around the coronode connection. A partial front wall 80 is provided with detents 82 to position the coronode wire as it extends therepast. A complementary cover front wall 84 is also provided at the front of cover 62 to complete the enclosure when the cover is closed.

With reference to FIG. 3, coronode 20 is generally a thin wire member, commonly a tungsten alloy. In the present embodiment, coronode 20 is supplied for installation with connectors 90 attached to either end of the coronode at a length selected in accordance with the particular device into which the coronode will be installed. In the particular embodiment shown, (as shown by the rotated inset to FIG. 3) connectors 90 may advantageously be small coil spring members, provided with a closed loop 92 at one end for securing the connectors 90 to the coronode, and an open hook 94 for securing the connector to anchors 68. It will no doubt be appreciated that the coronode wire could be also supplied in bulk, with separate connectors for assembly by the installer. Additionally, while providing spring members at either end of the coronode as connectors serves to assist in tensioning the coronode, by taking up slack in the wire, it may also be possible to preform the ends of the coronode with integral looped portions suitable for direct connection to the hooks or other support arrangements. In such a case the looped portions would integrally comprise the connectors 90.

With reference again to FIGS. 1 and 3, when cover 62 of second mounting block 14 is in a first, open position (as shown in FIG. 1) for stringing the coronode, anchors 68 are positioned at a first distance from the first end block 12, to allow connection of connectors 90 on coronode 20 in an untensioned condition to anchors 68. In pivoting cover 68 to a second, closed position (shown in FIG. 2), the arcuate movement of the anchors carries the attached coronode ends to a position more distant from the first end block, thereby applying tension to the coronode. Additionally, the second position carries the ends of the coronode to a position slightly below the partial front wall 80, positioning coronode 20 in detents 82. The bend applied to the coronode by its impingement on partial front wall 80, serves to further tension the coronode, prevents undesirable lateral movement and aids in the prevention of coronode vibration, a charging non-uniformity factor. Complementary interlocking tabs 100 and slots 102 in cover 68 and walls 74 and 76, respectively, serve to lock the cover into a closed position thereby maintaining the tensioned position. Assuming a constant predetermined length of corona wire mounted in the described arrangement, an identical amount of tension will be applied in stringing coronode 20 each time the task is performed.

Screen 22 may be comprised of a relatively thin sheet metal member having a generally U-shaped cross section with a mesh portion 110 formed in a central portion of the member, and supported adjacent the surface to be charged. The scorotron screen which can be inserted over end blocks 12 and 14 into slots 112 (shown only on first end block 12 for clarity) provided for such a purpose on the upper outside edges of each block. complementary mounting tabs 116 may integrally be provided on the screen for insertion into slots 112 to position the screen on the mounting blocks. Connection of the screen to a power supply is not shown, but could be accomplished in a variety of ways, including by way of example, connection to electrical contacts positioned within a machine frame.

It will no doubt be appreciated that single length coronodes may be used in a similar arrangements with minor modifications to end block 12. For example, a fixed anchor structure could be provided at the second end block, which would receive a connector similar to connector 90. The tensioning arrangement of the second end block 14 could also be modified to support only a single anchor on the pivoting cover assembly. Any number of coronodes could similarly be accommodated. Of course, it is also contemplated that the tensioning arrangement could be used on both end blocks, to simultaneously tension the coronode from both ends of the charging device. It will also be recognized that similar arrangements which integrally provide coronode tensioning for the stringing operation of the coronode with a mechanical advantage device movable from a position allowing untensioned mounting of the coronode, to a position applying a preselected tension to the coronode, may also come within the scope of the invention.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. A charging device for applying a charge to a surface in an electrostatographic device having a wire coronode; first and second end blocks for supporting the coronode in charging position with respect to a surface to be charged, at least one of the end blocks adaptable for electrically connecting the coronode to a high voltage power supply; and means for fastening the coronode between the insulating end blocks with a preselected tension, said fastening means including:

coronode connectors provided at either end of the coronode;

a coronode support member supported on the first end block for supporting the coronode at the first end block; and coronode tensioning means, supported on the second end block, for applying tension to the coronode, and including a tensioning member mounted for pivoting movement between first and second positions, said first position relatively closer to said coronode support member on the first end block than said second position with respect to the length of the coronode, said tensioning member supporting a coronode connector anchor, for receiving at least one of said coronode connectors, said first position of said pivoting movement allowing connection of the coronode connector to the coronode connector anchor with the coronode in a substantially untensioned condition, and said second position of said movement applying a preselected tension to said coronode.

2. The charging device as defined in claim 1 wherein said coronode connector are coil springs having a fixed connection to said coronode at a first end and a removable connection attachable to said coronode connector anchor at a second end.

3. The charging device as defined in claim 1 wherein said coronode tensioning means integrally forms a cover for a coronode connector enclosure formed in said first end block to enclose said coronode connector connected to said coronode connector anchor.

4. The charging device as defined in claim 1 wherein said tensioning member may be locked into said second position to maintain said applied selected tension.

5. A charging device for applying a charge to a surface in an electrostatographic device comprising:

a double length wire coronode with first and free second ends each provided with a coronode connector;

first and second end blocks forming supporting terminations for said coronode, said first end block providing a termination supporting a looped portion of said coronode and said second end block providing a termination for said first and second free ends of said coronode:

a coronode support member supported on said first end block for supporting said looped portion of said coronode at said first end block; and coronode tensioning means, supported on said second end block, for applying tension to said coronode, and including a pivot member mounted for pivoting movement between first and second positions, said pivot member supporting a pair of coronode connector anchors, for receiving said coronode connectors, said first position of the pivoting movement allowing connection of said coronode connectors to said coronode connector anchors while the coronode is in a substantially untensioned condition, and said second position of said pivoting movement applying a selected tension to said coronode.

6. The charging device as defined in claim 5 wherein said coronode support member is supported on said first end block within a partial enclosure, and extends outwardly from said enclosure for connection of said looped end of said coronode to said coronode support member, and is biasable inwardly to said partial enclosure with a first end block cover to substantially enclose said coronode termination.

7. The charging device as defined in claim 5 wherein said coronode connector is a coil spring having a fixed connection to said coronode at a first coil end and a removable connection to said coronode connector anchor at a second coil end.

8. The charging device as defined in claim 5 wherein said coronode tensioning means integrally forms a cover for a connector enclosure formed in the second end block to enclose said coronode connector connected to said coronode connector anchor when pivoted to said second position.

9. A charging device for applying a charge to a surface in an electrostatographic device including an integral arrangement for tensioning coronodes, said charging device comprising:

a prefabricated wire coronode having a predetermined length, and provided with coronode connectors at each end thereof;

first and second insulating end blocks for supporting said coronode in charging poosition with respect to a surface to be charged, at least one of said end blocks adaptable for electrically connecting said coronode to a high voltage power supply;

a conductive shield partially surrounding said coronode member and providing an opening adjacent a surface to be charged;

a coronode support member supported on said first end block for supporting said coronode at said first end block;

coronode tensioning means, supported on said second end block, for applying tension to said coronode, and including a pivot member mounted tfor pivoting movement between first and second positions, said pivot member supporting at least one coronode connector anchor, for receiving at least one of said coronode connectors, said first position of said pivoting movement allowing connection of said coronode connector to said coronode connector anchor while said coronode is untensioned, and said second position of said pivoting movement applying a selected tension to said coronode.

* * * * *